US008167710B2

(12) United States Patent
Agarwal et al.

(10) Patent No.: US 8,167,710 B2
(45) Date of Patent: May 1, 2012

(54) CONTROLLING AND CONFIGURING RESPONSIBLE GAMING DATA

(75) Inventors: Vijay K. Agarwal, Hoffman Estates, IL (US); Mary M. Burke, Somonauk, IL (US); Elias R. Maskaleris, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/127,496

(22) PCT Filed: Nov. 4, 2009

(86) PCT No.: PCT/US2009/063321
§ 371 (c)(1),
(2), (4) Date: May 4, 2011

(87) PCT Pub. No.: WO2010/054027
PCT Pub. Date: May 14, 2010

(65) Prior Publication Data

US 2011/0245943 A1 Oct. 6, 2011

Related U.S. Application Data

(60) Provisional application No. 61/111,496, filed on Nov. 5, 2008.

(51) Int. Cl.
*A63F 9/24* (2006.01)

(52) U.S. Cl. ..... 463/25; 463/29

(58) Field of Classification Search ..... 463/25, 463/29

See application file for complete search history.

(56) References Cited

U.S. PATENT DOCUMENTS

| | | | | |
|---|---|---|---|---|
| 2001/0031663 | A1 * | 10/2001 | Johnson | 463/42 |
| 2003/0211878 | A1 * | 11/2003 | Walker et al. | 463/13 |
| 2005/0255922 | A1 * | 11/2005 | Nguyen et al. | 463/42 |
| 2006/0100009 | A1 | 5/2006 | Walker et al. | |
| 2006/0211493 | A1 | 9/2006 | Walker et al. | |
| 2007/0259714 | A1 | 11/2007 | Block et al. | |

FOREIGN PATENT DOCUMENTS

| | | |
|---|---|---|
| JP | 10192537 | 7/1998 |
| JP | 200245557 | 2/2002 |
| JP | 2005118431 | 5/2005 |
| JP | 200687714 | 4/2006 |
| JP | 2006116244 | 5/2006 |
| WO | WO2007107883 | 9/2007 |
| WO | WO2010054027 | 5/2010 |

OTHER PUBLICATIONS

"PCT Application No. PCT/US09/63321 International Preliminary Report on Patentability", Oct. 5, 2010 , 9 pages.
"PCT Application No. PCT/US09/63321 International Search Report", Dec. 29, 2009 , 8 pages.

* cited by examiner

*Primary Examiner* — Omkar Deodhar
(74) *Attorney, Agent, or Firm* — DeLizio Gilliam, PLLC

(57) ABSTRACT

A wagering game system and its operations are described herein. In embodiments, the operations can include determining a player account that is logged in to a wagering game session and presenting a wagering game during the wagering game session. The operations can further include determining accounting transaction data that relates to an amount of money that the player account has spent on gambling during a time period. The operations can further include presenting the accounting transaction data during the wagering game session so that the accounting transaction data and the wagering game are both perceptible to the player account. The operations can also include indicating the amount of money that the player account has spent on gambling in the time period.

24 Claims, 7 Drawing Sheets

CONTROLLING AND CONFIGURING RESPONSIBLE GAMING DATA

RELATED APPLICATIONS

This application claims the priority benefit of U.S. Provisional Application Ser. No. 61/111,496 filed Nov. 5, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

TECHNICAL FIELD

Embodiments of the inventive subject matter relate generally to wagering game systems and networks. More particularly, the inventive subject matter relates to responsible gaming systems and networks.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

However, for some people, playing wagering games in excess can lead to negative issues and problems with over spending and addictive gambling behaviors. Wagering game providers are concerned with these negative issues that face the gaming industry and are attempting to determine ways to assist wagering game players to gamble responsibly.

SUMMARY

In some embodiments, a method comprises determining a player account that is logged in to a wagering game session; presenting a wagering game during the wagering game session; determining accounting transaction data that relates to an amount of money that the player account has spent on gambling during a time period; presenting the accounting transaction data, during the wagering game session, so that the accounting transaction data and the wagering game are both perceptible to the player account; and indicating the amount of money that the player account has spent on gambling in the time period.

In some embodiments, presenting the accounting transaction data comprises one or more of intrusively presenting indicators of wagering game loss amounts as one or more of graphic indicators in close proximity to a visual display of the wagering game and sound indicators presented during the wagering game session.

In some embodiments, tracking the accounting transaction data comprises tracking a change in a player account balance during the wagering game session, and presenting visual representations of the change in the player account balance to represent the amount of money that the player account has spent on gambling during the wagering game session.

In some embodiments, the method further comprises determining a transaction report template pre-configured to present the accounting transaction data on a display in close proximity to wagering game elements of the wagering game; and presenting the accounting transaction data, using the transaction report template, during the wagering game session.

In some embodiments, the method further comprises exporting the accounting transaction data; and presenting the accounting transaction data on a financial report outside of the wagering game session.

In some embodiments, the method further comprises determining one or more additional player accounts associated with the player account; and presenting additional accounting transaction data for the additional accounts during the wagering game session.

In some embodiments, one or more machine-readable media having instructions stored thereon, which when executed by a set of one or more processors causes the set of one or more processors to perform operations comprises tracking accounting transaction data during a wagering game session for a player account, wherein the accounting transaction data relates to an amount of financial transactions that the player account has transacted on gambling during a time period; determining one or more player preferences, for the player account, regarding the presentation of the accounting transaction data during the wagering game session; presenting the accounting transaction data according to the one or more player preferences so that the accounting transaction data is perceptible to the player account during the wagering game session; determining a transaction limit set in the one or more player preferences, wherein the transaction limit indicates a limit on a use of funds for the player account; and indicating the transaction limit during the wagering game session.

In some embodiments, the operations further comprise applying the transaction limit to one or more other accounts associated with the player account.

In some embodiments, the operation of indicating the transaction limit comprises displaying a graphic of a limit value in visual proximity to wagering game elements presented during the wagering game session.

In some embodiments, the operations further comprise presenting one or more warnings messages indicating that the use of the funds is approaching the transaction limit.

In some embodiments, the operations further comprise presenting one or more suggestions to reduce wagering activity so that the use of the funds comports with the transaction limit.

In some embodiments, the operations further comprise presenting one or more incentives to terminate wagering activity when the transaction limit is close to being exceeded.

In some embodiments, the operations further comprise determining that the transaction limit has been exceeded; and restricting wagering game activities that the player account can perform during the wagering game session.

In some embodiments, a system comprises a wagering game server configured to provide wagering game content during a wagering game session; an account server configured to store one or more player preferences for a player account, wherein the one or more player preferences indicate preferences for presenting accounting transaction data during the wagering game session; and a wagering game machine comprises a content controller configured to present the wagering game content on a display, and an account data controller configured to track the accounting transaction data for the player account during the wagering game session, wherein the accounting transaction data relates to financial transactions that the player account has transacted during the wagering game session, determine the one or more player preferences, and present the accounting transaction data on the display in close proximity to the wagering game content, according to the one or more player preferences, so that the accounting transaction data is visible during the wagering game session.

In some embodiments, the wagering game machine further comprises a report selection controller configured to select report templates that present the financial transactions during the wagering game session.

In some embodiments, the wagering game server further comprises an incentives manager configured to present one or more of suggestions and incentives to modify wagering activity to maintain wagering within pre-determined limits; and a limit controller configured to restrict wagering game activity based on the pre-determined limits.

In some embodiments, the account data controller is further configured to generate financial graphs showing the accounting transaction data, and present the financial graphs on the display according to one or more pre-defined financial report templates.

In some embodiments, an apparatus comprises a responsible gaming module configured to, determine accounting transaction data for a player account, wherein the accounting transaction data relates to one or more wagering transactions that the player account has transacted during a time period, determine that the player account is logged in to a wagering game session, present the accounting transaction data and wagering game content so that the accounting transaction data and the wagering game content are visible during the wagering game session, and present financial transaction statistics for other player accounts during the time period.

In some embodiments, the responsible gaming module is further configured to generate a comparison between the accounting transaction data to the financial transaction statistics, and present the comparison in a comparison graphic during the wagering game session.

In some embodiments, the accounting transaction data comprises one or more of withdrawals, deposits, and wagers.

In some embodiments, an apparatus comprises means for determining accounting transaction data for a player account; means for determining one or more player preferences, for the player account, regarding presentation of the accounting transaction data during a wagering game session; means for determining a financial report template indicated by the one or more player preferences, wherein the financial report template is configured to present the accounting transaction data on a display during the wagering game session; means for presenting the accounting transaction data on a financial report on the display using a transaction report template; means for determining a transaction limit set in the one or more player preferences; and means for indicating the transaction limit, on the financial report, during the wagering game session.

In some embodiments, the apparatus further comprises means for detecting the transaction limit is set by one or more of the player account and a third-party monitoring account.

In some embodiments, the apparatus further comprises means for presenting an incentive to terminate the wagering game session when the transaction limit is close to being exceeded.

In some embodiments, the apparatus further comprises means for presenting a report generation tool to customize the financial report template.

In some embodiments, the apparatus further comprises means for determining that the transaction limit is exceeded; and mean for presenting a warning message that intrudes on the wagering game session, wherein the warning message indicates that the transaction limit has been exceeded.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

As mentioned previously, wagering game providers face challenges determining ways to assist wagering game players to gamble responsibly. Embodiments of the inventive subject matter, however, present solutions to many of those challenges. Embodiments of the inventive subject matter present ways to encourage and enforce responsible gaming in an account based gaming system. Some embodiments can present a player account's actual account statistics during a wagering game session. Some embodiments can present wagering statistics and trends in reports. The player can select from report templates to present and organize the account statistics. In some embodiments, the system can enforce limits and encourage players to restrict gaming activity when those limits are exceeded or close to being exceeded. For example, some embodiments present incentives to reduce gaming activity when the limits are exceeded or close to being exceeded. These embodiments, and many others, are described in further detail below. For example, FIGS. 1 and 3 describe examples of presenting a player account's financial statistics during a wagering game session using responsible gaming settings and report templates, and FIGS. 4 and 5 describe examples of presenting responsible gaming incentives, trend statistics, limits, and other information during a wagering game session.

In some embodiments herein a player may be referred to interchangeably as a player account, or vice versa. Account based gaming systems often utilize player accounts when transacting and performing activities, at the computer level, that are initiated by players. Therefore a "player account" is often referred to herein as a representative of the player at a computerized level. Therefore, for brevity, to avoid having to describe the interconnection between player and player account in every instance, a "player account" may be referred to herein in either context. Further, in some embodiments herein, the word "gaming" is used interchangeably with the word "gambling".

Figure 1:
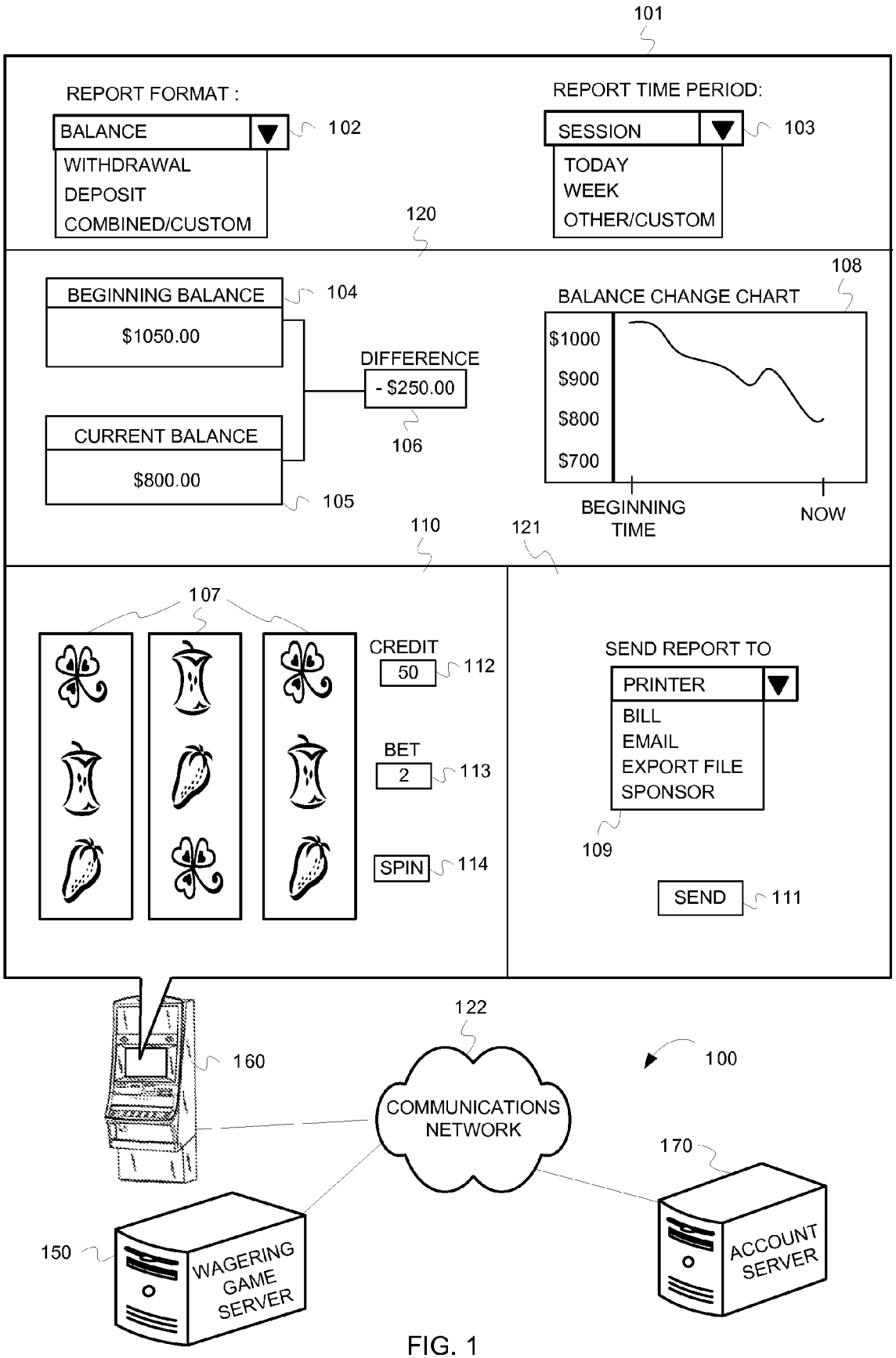
FIG. 1 is an illustration of presenting a player account's financial statistics during a wagering game session using responsible gaming settings and report templates, according to some embodiments.
Figure 2:
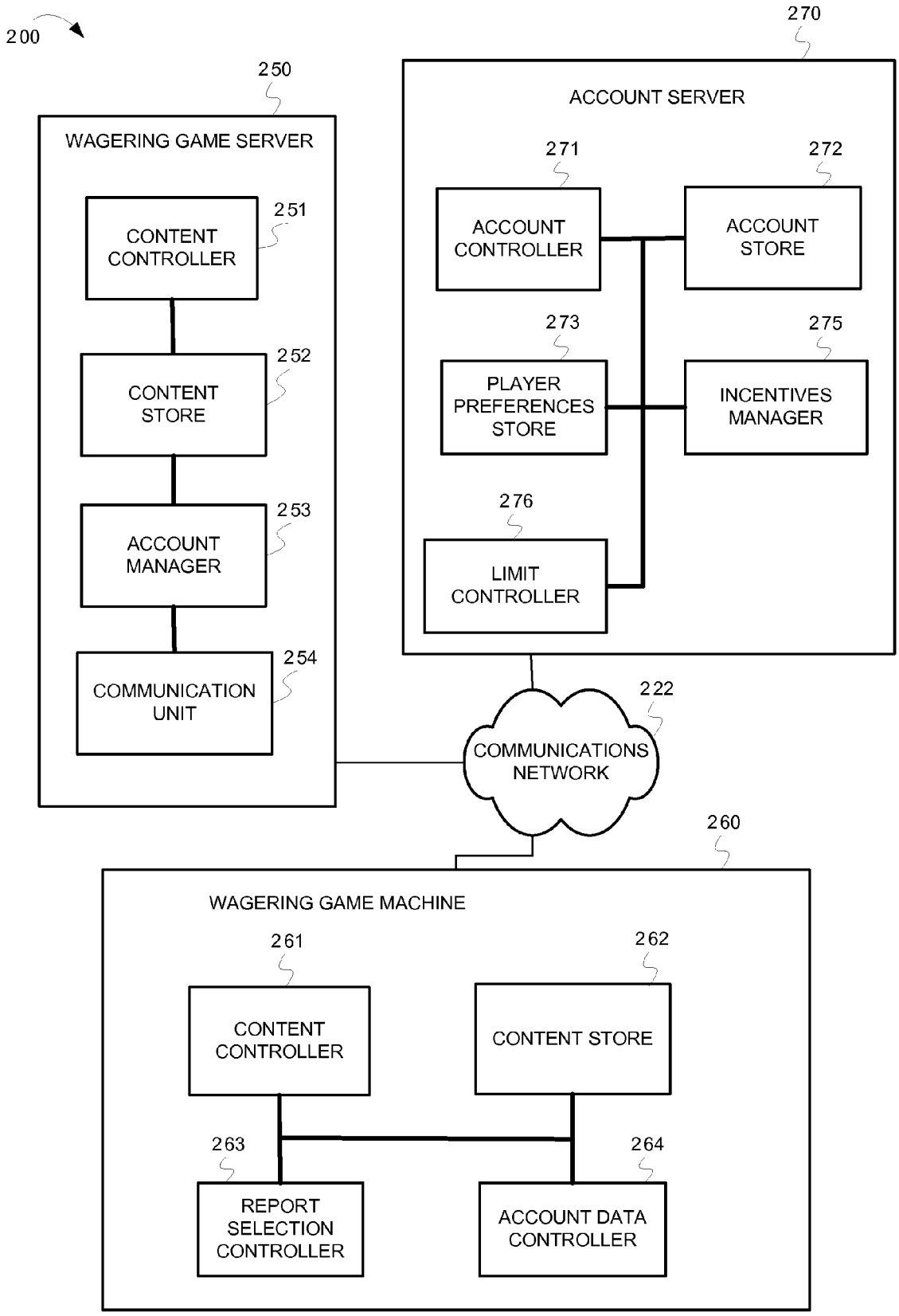
FIG. 2 is an illustration of a wagering game system architecture 200, according to some embodiments.

FIG. 1 is a conceptual diagram that illustrates an example of presenting a player account's financial statistics during a wagering game session using responsible gaming settings and report templates, according to some embodiments. In FIG. 1, the wagering game system ("system") 100 includes a wagering game server 150 connected to a wagering game machine 160 via a communications network 122. The wagering game server 150 can be connected to a casino network that includes one or more casino network devices associated with a casino network such as additional wagering game servers, account servers, awards servers, community game servers, advertising servers, monitoring equipment, or other devices. FIG. 2 illustrates an example architecture of a wagering game server 250 according to some embodiments. The wagering game machine 160 has a display 101 that can present a wagering game (e.g., slot reels 107, a credit meter 112, a bet meter 113, and a spin control 114) in a wagering game display 110. The system 100 can also include an account server 170 that stores and controls a player account. The player account can login to the wagering game machine 160 and play the wagering game. The display 101 can also present a financial report 120 of account transactions that the player account has conducted over a period of time. The time period can be predetermined times, calendar times, custom defined times, irregular time periods, etc. For example, the system 100 can determine a pre-arranged period of time specific by a player account and monitor the player account's financial activity over that period of time (e.g., a player specifies a spending limit of $1000 over a 48-hour time period). The system 100 can monitor the time period beginning from a specific time (e.g., starting at 12 pm Tuesday) or from a trigger activity (e.g., from a point at which the player account begins using funds for wagering), etc. The system 100 can present the financial report 120 to indicate a number, total, or other quantification of financial transactions that notify the player account how much money has been spent on gambling during a selected time period. The system 100 can present the financial report 120 during the wagering game session, in close proximity to the wagering game, to indicate to the player account, while gambling, the total amounts of money withdrawn, spent, bet, deposited, etc.

The wagering game machine 160 can present the financial report 120 simultaneously while presenting a wagering game in the wagering game display 110, between wagers, upon request of the player account, or at any time during the wagering game session, to provide a perceptible indicator of the amounts of money that the player account has spent, won, lost, transacted, etc., on gambling. The system 100 can present the financial report 120 in any location on the wagering game machine 160, or on any other device, that is viewable during the wagering game session, for example, (1) as a part of the display 101 (e.g., in a separate window or frame from the wagering game), (2) on a peripheral device connected to the wagering game machine 160 (e.g., on a box-top monitor, on a side monitor, etc.), (3) on a personal device wirelessly connected to the wagering game machine 160 (e.g., via text messages on a cell phone, via spoken amounts on a personal digital assistant), (4) on a secured website, etc. The system 100, thus, imposes the financial report 120, or some other indication of the accounting data, in an intrusive manner on the gambling activity to ensure that the player account has notification that gambling activity may be exceeding, or has exceeded, responsible gambling boundaries.

The system 100 can present a report selection control 102 to select a report template that controls the information presented in the financial report 120. The report template can be a stored template, or other form of metadata, that can select and present account information tracked and stored by the account server 170, the wagering game machine 160, and the wagering game server 150. In some embodiments, the account server 170 can store the report template and other preferences related to the financial report 120. In other embodiments, other devices (e.g., the wagering game 160, the wagering game server 150, etc.), can store the report templates and other preferences related to the financial report 120. The report template can change the type of information presented on the financial report 120, including different transaction types (e.g., withdrawals, bets, deposits, etc.), different graphs (e.g., money transacted, trends, etc.), transaction limits, warnings, suggestions for conserving funds, incentives for performing responsible gambling activity, game play statistics related to financial transactions, and other such information. For instance, a specific report template may present changes in an account balance, including a textual representation of the change in the account balance via a beginning balance value 104, an ending balance value 105, and a balance difference value 106. The balance difference value 106 indicates how much the account balance has changed for the time period selected in a time period control 103. The time period control 103 may include a dropdown, or other selection menu, that a player account can use to select time period parameters for the financial statistics that are presented in the financial report 120. The report template can also present graphical representations of the change in the account balance via a balance change chart 108. The balance change chart 108 can illustrate numerical account balance values in an easily viewable format so that the player account can quickly view and comprehend gambling trends for the selected time period.

The system 100 can also present panels or controls for using the report (e.g., in a wagering game machine interface, on a website interface, on a kiosk interface, etc.). For example, the system 100 can present a report export panel 121 with a report destination dropdown 109 and a report submission control 111. The report destination dropdown 109 can include selection options of where to send the financial data in the financial report 120 (e.g., a printer, a bill, an email, an export file, a sponsor friend or family member account, an administrative account, a website, a personal storage device, etc.). The player account can select the report submission control 111 to transmit the financial data. In some embodiments, the system 100 can use export templates for presenting the financial report 120 on a final medium (e.g., a final destination document, file, disk, etc.). The export templates can also convert the data into formats that can be used in various data sources and file formats (e.g., comma separated value, dBase, etc.). In some embodiments, the system 100 can generate reports by themes or topics. The system 100 can also show positive information about game play (e.g., amounts won over a time period).

Although FIG. 1 describes some embodiments, the following sections describe many other features and embodiments. Further, although FIG. 1 and other Figures herein illustrate embodiments for controlling and configuring responsible gambling using wagering game machines, other embodiments can present account statistics and financial information, present report templates, provide incentives to reduce gaming activity, etc., on other devices capable of presenting wagering games (e.g., personal computers, cell phones, etc.). In some embodiments, the system can present options to view accounting data during wagering game sessions (e.g., an on/off switch or setting). Further, although FIG. 1 illustrates a certain type of wagering game machine 160, the wagering game machines described herein can take any suitable form, such as floor standing models, handheld mobile units, bar-top models, workstation-type console models, surface computing machines, etc. Further, the wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as a thin, thick, or intermediate client. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

EXAMPLE OPERATING ENVIRONMENTS

This section describes example operating environments and networks and presents structural aspects of some embodiments. More specifically, this section includes discussion about wagering game system architectures.

Wagering Game System Architecture

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 271 configured to control information for a player's account. The account server 270 can also include an account store 272 configured to store information for a player's account. The account server 270 can also include a player preferences store 273 configured to store player preferences for settings regarding account transactions, spending limits, report templates, and other information related to responsible gaming. The account server 270 can also include an incentives manager 275 configured to present suggestions and incentives to reduce wagering activity to maintain financial activity within predetermined limits. The account server 270 can also include a limit controller 276 configured to control limits stored in the player preferences store 273. The limit controller 276 can also be configured to restrict wagering game activity based on the limits. The limit controller 276 can also be configured to apply limits to other accounts associated with the player account (e.g., other casino accounts).

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks.

The wagering game system architecture 200 can also include the wagering game machine 260 configured to present wagering games and receive and transmit information to encouraging and enforcing responsible gaming. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include a report selection controller 263 configured to select report templates that present financial transactions during a wagering game session. The wagering game machine 260 can also include an account data controller 264 configured to generate data, graphs, and other presentations of account information, including financial spending on wagering game activities. The account data controller 264 can also be configured to send the data to one or more locations and/or devices external to a wagering game machine (e.g., to a customer's casino bill, to a printer, to a website, to a personal storage device, etc.). The account data controller 264 can also convert the data into different formats for use on other devices, on data sources, etc. The account data controller 264 can also be configured to present account data to other accounts associated with the player account (e.g., administrative accounts, friend accounts, family accounts, sponsor accounts, etc.). The account data controller 264 can also be configured to present financial account data from other accounts (e.g., friend and/or family accounts, other casino accounts linked to a player account, etc.).

Each component shown in the wagering game system architecture 200 is shown as a separate and distinct element connected via a communications network 222. However, some functions performed by one component could be performed by other components. For example, the wagering game server 250 can also be configured to perform functions of the report selection controller 263, the account data controller 264, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

EXAMPLE OPERATIONS

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
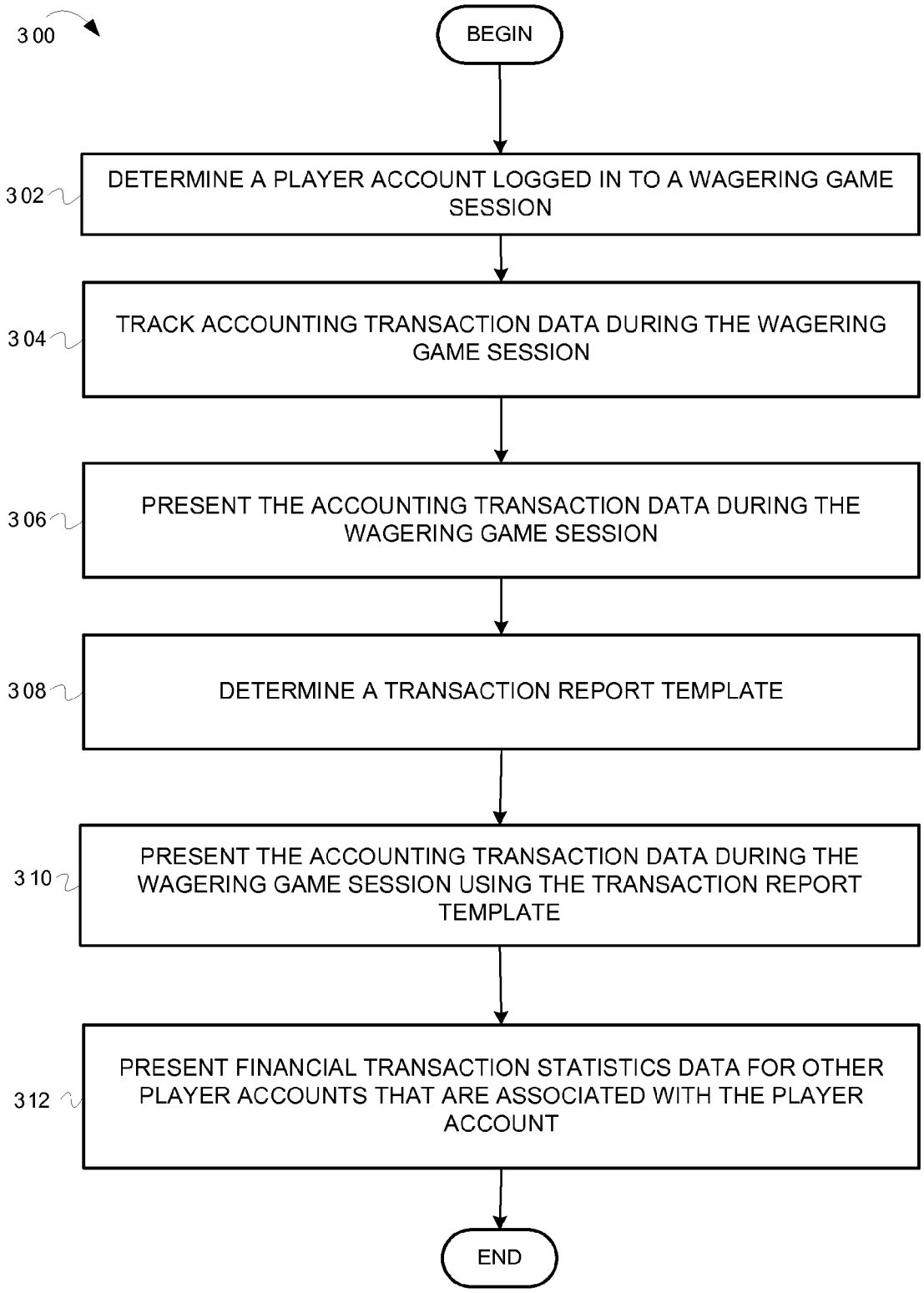
FIG. 3 is a flow diagram 300 illustrating presenting a player account's financial statistics during a wagering game session, according to some embodiments.
Figure 5:
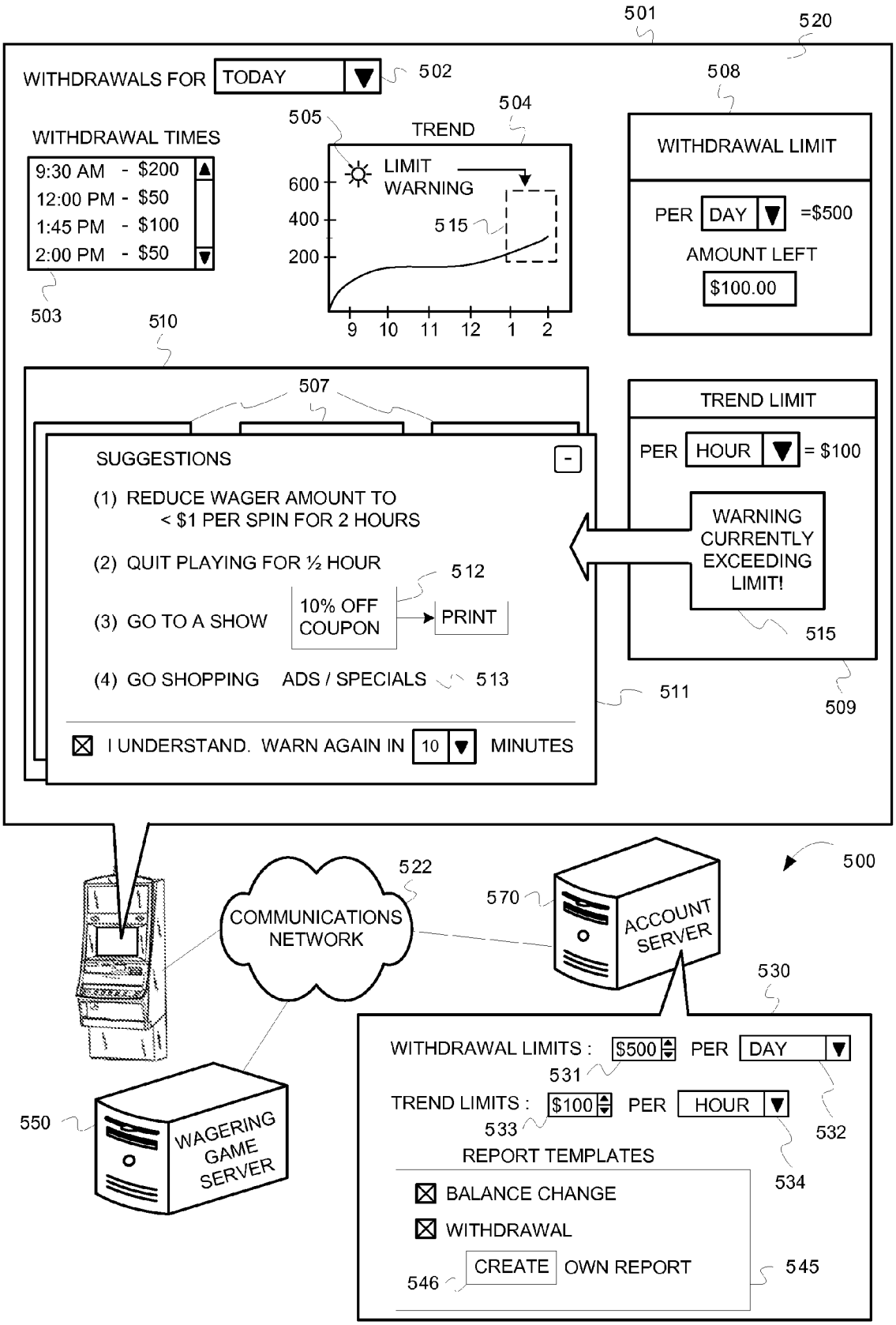
FIG. 5 is an illustration of a wagering game system 500, according to some embodiments.

FIG. 3 is a flow diagram ("flow") 300 illustrating presenting a player account's financial statistics during a wagering game session, according to some embodiments. FIGS. 1 and 5 are conceptual diagrams that help illustrate the flow of FIG. 3, according to some embodiments. This description will present FIG. 3 in concert with FIGS. 1 and 5. In FIG. 3, the flow 300 begins at processing block 302, where a wagering game system ("system") determines a player account for a wagering game session. For example, in FIG. 1, the system 100 can determine that a player logs in to the wagering game machine 160 using player account credentials. The system 100 can facilitate the login by accepting login credentials via a card swipe, a password entry, etc., and connect the player to the player account hosted by the account server 170. The system 100 can also communicate account information between the wagering game machine 160, the account server 170 and the wagering game server 150.

The flow 300 continues at processing block 304, where the system tracks accounting transaction data during the wagering game session. In some embodiments, the system can track monetary accounting transactions, such as cash and credit withdrawals, deposits, and wagers. The system can also track non-monetary transactions, such as accumulations of non-cash awards (e.g., status points, customer appreciation points, free spins, etc.). The accounting transaction data can include raw accounting data pertaining to any activity on a player account's wagering activities. In some embodiments, the system can track a change in a player account balance and present that information. In some embodiments, the system can track the accounting transaction data during the wagering game session and/or determine accounting data from other periods (e.g., a series of sessions, a period of days, etc.). FIG. 1 illustrates an example of tracking a player account balance and presenting values of the account balance over a time period for a wagering game session. FIG. 5, on the other hand, illustrates an example of tracking player withdrawals over another time period (i.e., a day), which may include accounting transaction data from the wagering game session and from other wagering game sessions conducted during the day. Therefore, although flow 300 describes tracking and presenting accounting transaction data from a wagering game session that a player account is currently conducting, other embodiments can determine and present accounting transaction data from the wagering game session combined with other periods (e.g., the period of "today", the period of "to date", etc.) or from other periods that don't contain the accounting transaction data from the current wagering game session (e.g., the period of "last week", the period of "last year", etc.).

The flow 300 continues at processing block 306, where the system presents the accounting transaction data during the wagering game session. In some embodiments, the system can present the accounting transaction data ("accounting data") per game, per session, per day, or for other time periods (e.g., duration of a hotel stay, each year, over a lifetime). The system can also present accounting data per activities or subject matters (e.g., per player request, by game classifications, by game types, by game themes, etc.). The system can utilize visual and audible notifications to present the accounting data. The system can utilize warning indicators, charts of wagering activity, and pop-ups reminders, etc. The system can present the accounting data in auxiliary windows, devices, on a website, etc. In some embodiments, the locations and positions of the accounting data can be pre-configured on a display. In other embodiments, a player account can configure when and how the accounting transaction data is presented on a display. In some embodiments, the system can convert the accounting transaction data to a transportable file format (e.g., so that player can import into personal financial software, so that player can store in a text file/spreadsheet, so that player can store in a database, etc.). In some embodiments, the system can present the accounting data to a third party monitoring account (e.g., a gambling buddy, a spouse, an administrative user, a casino staff member, etc.). In some embodiments, the system can present accounting information for other player accounts that are associated with the player account (e.g., linked accounts, multiple sub-accounts to the one account, etc.). In some embodiments, the system can present accounting data as is relates to game-play statistics (e.g., the accounting data per minutes played over time, accounting data for peak play hours, accounting data for winning periods versus losing periods, etc.). The accounting data that is related to game-play statistics can help the player to determine spending trends based on their play performance, their amount of time in a wagering game session, etc. The system can also provide controls so that a player can enter values of what the player believes their time to be worth. The system may provide controls to value some times more than others (i.e., different times may be more valuable or guarded than others). The system can then determine an equivalent money amount in lost time. The system can set limits on gambling based on times, time ranges, time values, etc. (e.g., the system prevents gambling during family meal times).

The flow 300 continues at processing block 308, where the system determines a transaction report template. The system can provide controls for a player account to select the transaction report template ("report template"). For example, in FIG. 1, a player account can select from the selection tool (e.g., the report selection control 102) to select a report template that controls the information presented in a financial report. The report template can be one or many default report templates provided by the system. For example, in FIG. 5, an account server 570 is connected to a wagering game machine 560 and a wagering game server 550 via a communications network 522. The account server 570 can host a player account that can be presented in an account interface 530. The account interface 530 can include a report template setting 545 which the player account can use to select default report templates that may appear from a selection menu on a player interface (e.g., a wagering game system ("system") 500 can place selected templates from the report template setting 545 in the report selection control 102). In some embodiments, the system can provide a report creation control 546 that launches a report creation tool to generate custom reports. The report creation tool can also import and export custom reports so that the player account can share and/or receive custom reports created by other player accounts or third parties.

The flow 300 continues at processing block 310, where the system presents the accounting data using the transaction report template. FIGS. 1 and 5 illustrate examples of presenting the accounting data. For example, in FIG. 1, the wagering game machine 160 can present the financial report 120. In FIG. 5, the wagering game machine 560 can present the account data in an auxiliary portion 520 of a display 501 according to a default or pre-selected report template. In some embodiments, the system 500 can present account data by cycling through report templates selected in the report template setting 545. In other embodiments, the system 500 can determine the report template to use based on spending or other financial use trends that the system recognizes. For example, in FIG. 5, the system 500 presents a report on account withdrawals as the player account's withdrawal activity trends toward pre-determined withdrawal limits set within the account interface 530.

The flow 300 continues at processing block 312, where the system presents financial transaction statistics data for other player accounts. In some embodiments, the system can show statistics for other players on average for how they are betting at the time. The system can present the statistics for the other players as anonymous information without revealing the other player's personal information. The system can provide a gauge of the current gambling feel of a casino environment over short time periods. The gauge indicates whether the player is gambling responsibly based on statistical information such as other players' gambling activities in the short term, typical responsible gamer activity, perceived responsible gaming, etc. The system can present data from other player accounts that are playing other wagering game sessions simultaneously with the player account's wagering game session. In some embodiments, the system can compare the player's statistics to other gamers that match specific criteria, such as gamers with similar financial backgrounds, gamers with similar amounts of play time, etc. The gauge can also indicate past player activity and/or compare current play to past player activity.

Figure 4:
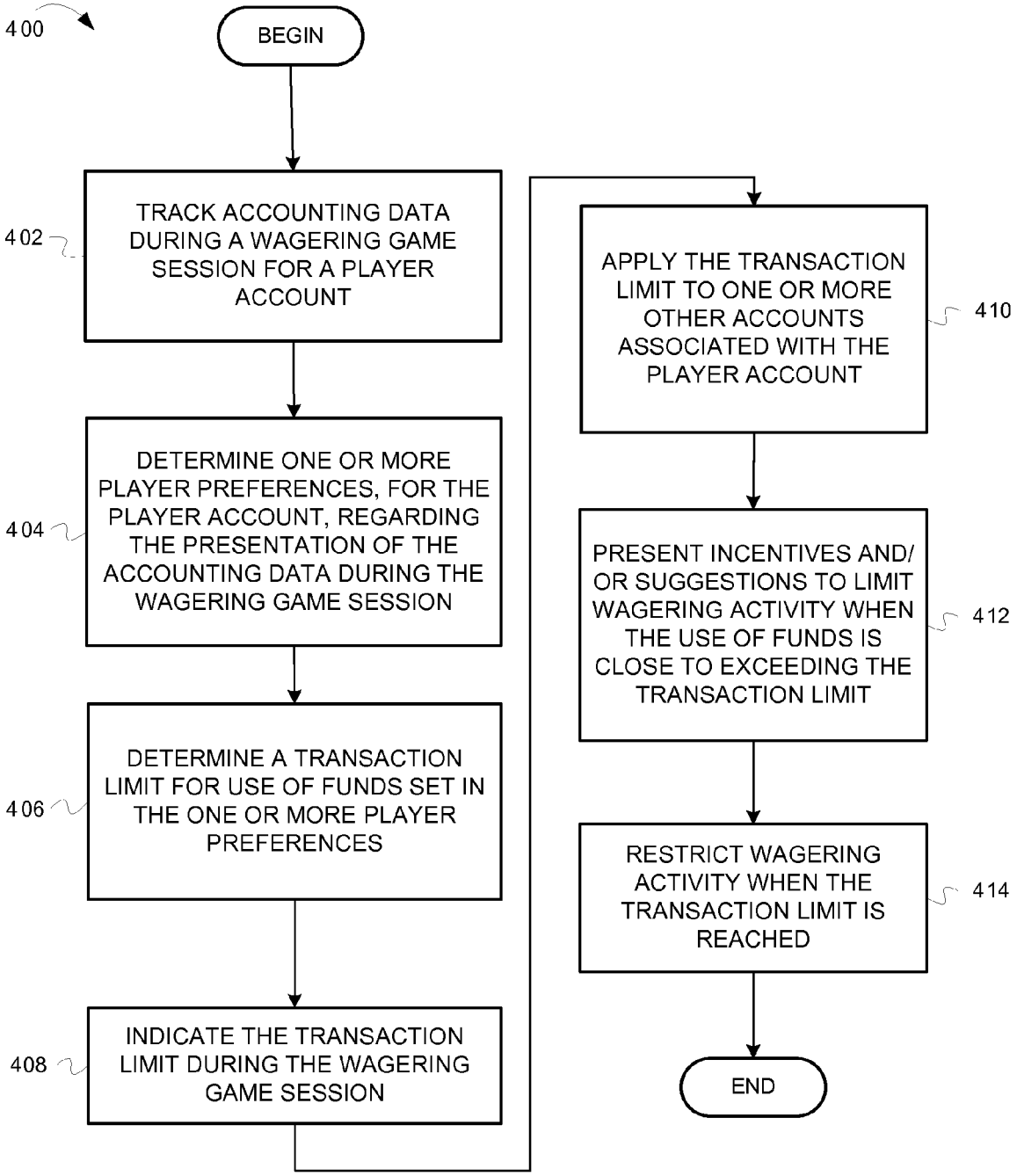
FIG. 4 is a flow diagram 400 illustrating presenting responsible gaming incentives, trend statistics, limits, and other information during a wagering game session, according to some embodiments.

FIG. 4 is a flow diagram ("flow") 400 illustrating presenting responsible gaming incentives, trend statistics, limits, and other information during a wagering game session, according to some embodiments. FIG. 5 is a conceptual diagram that helps illustrate the flow of FIG. 4, according to some embodiments. This description will present FIG. 4 in concert with FIG. 5. In FIG. 4, the flow 400 begins at processing block 402, where a wagering game system ("system") tracks accounting transaction data ("accounting data") during a wagering game session for a player account.

The flow 400 continues at processing block 404, where the system determines one or more player preferences, for the player account, regarding the presentation of the accounting data during the wagering game session. For example, in FIG. 5, the account interface 530 includes various player preferences regarding the accounting data.

The flow 400 continues at processing block 406, where the system determines a transaction limit set in the one or more player preferences. For example, in FIG. 5, the account interface 530 includes a withdrawal limit control 531 that indicates a withdrawal limit value for withdrawals within a time period selectable by a first time period control 532. The account interface 530 also includes a withdrawal trend limit control 533 that indicates a withdrawal limit for a smaller portion of the time period set in the first time period control 532 (e.g., via a second time period control 534). In some embodiments, the system 500 can detect transaction limits set by other accounts, such as a trusted third-party monitoring account (e.g., a designated administrator account controlled by a spouse, an accountant, a responsible friend, etc.). The system 500 can also determine multiple transaction limits (e.g., the withdrawal limit value set in the withdrawal limit control 531 and the withdrawal trend limit value set in the withdrawal trend limit control 533).

The flow 400 continues at processing block 408, where the system indicates the transaction limit during the wagering game session. For example, in FIG. 5, the system 500 can indicate the transaction limit by displaying the value of the withdrawals limit in a withdrawal limit display 508. The system 500 can also display the value of the withdrawal trend limit in a withdrawal trend limit display 509. The system 500 can also present the limits on a trend chart 504. The trend chart 504 indicates a graphical representation of withdrawals made at different times during the time period indicated in a time period control 502. The system 500 can also present the withdrawal times and values in a withdrawal times list 503. The system 500 can present messages, or warnings, indicating that a use of funds is approaching a limit. For example, the system 500 presents a warning light 505 and a warning box 515 indicating that the player account's withdrawal trend per hour is exceeding the $100/hour limit (i.e., for the period of time between 1 PM and 2 PM, the player withdrew more than $100, so the graphed value increases steeply and the warning box 515 highlights the steep graph increase). In some embodiments, the system can provide notifications when the limits are close to being reached (e.g., the system 500 notifies the player account when fund usage is within 10% of limit amounts). The system 500 can send also text messages to friends when limits are reached or about to be reached. Further, the system 500 can utilize player configured templates to determine and present limits. The system 500 can also send emails to email accounts to notify third-party monitoring accounts that the limits have been exceeded. The flow 400 continues at processing block 410, where the system applies the transaction limit to one or more other accounts associated with the player account. In some embodiments, the system can track across casinos and online wagering activity and cross reference other accounts belonging to, and/or accessible to, the player account that don't have limits. The system 500 can apply the limits from the player account to those other accounts. For example, the player account may be a designated account and been provided access by other account owners. In some embodiments, the player account may control or own the other accounts (e.g., the other accounts are owned by the player account but are hosted by different casino servers, the other accounts are sub-accounts for authorized wagering accounts, the other accounts are family members' accounts funded by the player account, etc.).

The flow 400 continues at processing block 412, where the system presents an incentive and/or a suggestion to limit wagering activity when the use of funds is close to exceeding the transaction limit. For instance, in FIG. 5, the system 500 can present a suggestions box 511 indicating suggestions and/or incentives to reduce or terminate wagering activity and to preserve the use of funds. The suggestions box 511 can cover portions of the wagering game elements within a wagering game display 510 (e.g., cover reels 507) so that the player account is certain to acknowledge the suggestions. The system 500 can calculate times and amounts that a player account would need to reduce, correct, or otherwise modify their gambling activities to ensure that the player account returns to betting activity that is within the limits. The system 500 can present those calculated times and amounts as suggestions within the suggestions box 511. The system 500 can offer incentives, such as a coupon 512 to perform other entertaining casino activities. The coupon 512 can have a monetary value (e.g., 10% off admission to a show, 10% off prices for a buffet, 10% off a drink at the bar, etc.). The system 500 can include an expiration time (e.g., within 10 minutes) on the coupon 512 to encourage the player to take the incentive and use it. The system 500 can also personalize the coupon 512 so that only the player account is eligible to use it (e.g., make it non-transferrable). The suggestions box 511 can also include an advertisement button 513 that can present advertisements or special offers for the player. The suggestions box 511 can also include acknowledgement controls that require the player account to acknowledge the warnings, suggestions, etc. or that remind the player account periodically as long as the limit is being exceeded.

The flow 400 continues at processing block 414, where the system restricts wagering activity when the limit is reached. In some embodiments, the system can restrict what a player account can do, based on the account data presented during the wagering game session. For example, the system can prevent wagers after the player account has exceeded limits. In some embodiments, the system can restrict wagering activity for limits on single bets (e.g., limit bets to be less than $1 as suggested in the suggestions box 511) as well as for the wagering game session (e.g., limit wagering games for ½ hour as also suggested in the suggestions box 511).

ADDITIONAL EXAMPLE OPERATING ENVIRONMENTS

This section describes example operating environments, systems and networks, and presents structural aspects of some embodiments.

Wagering Game Machine Architecture

Figure 6:
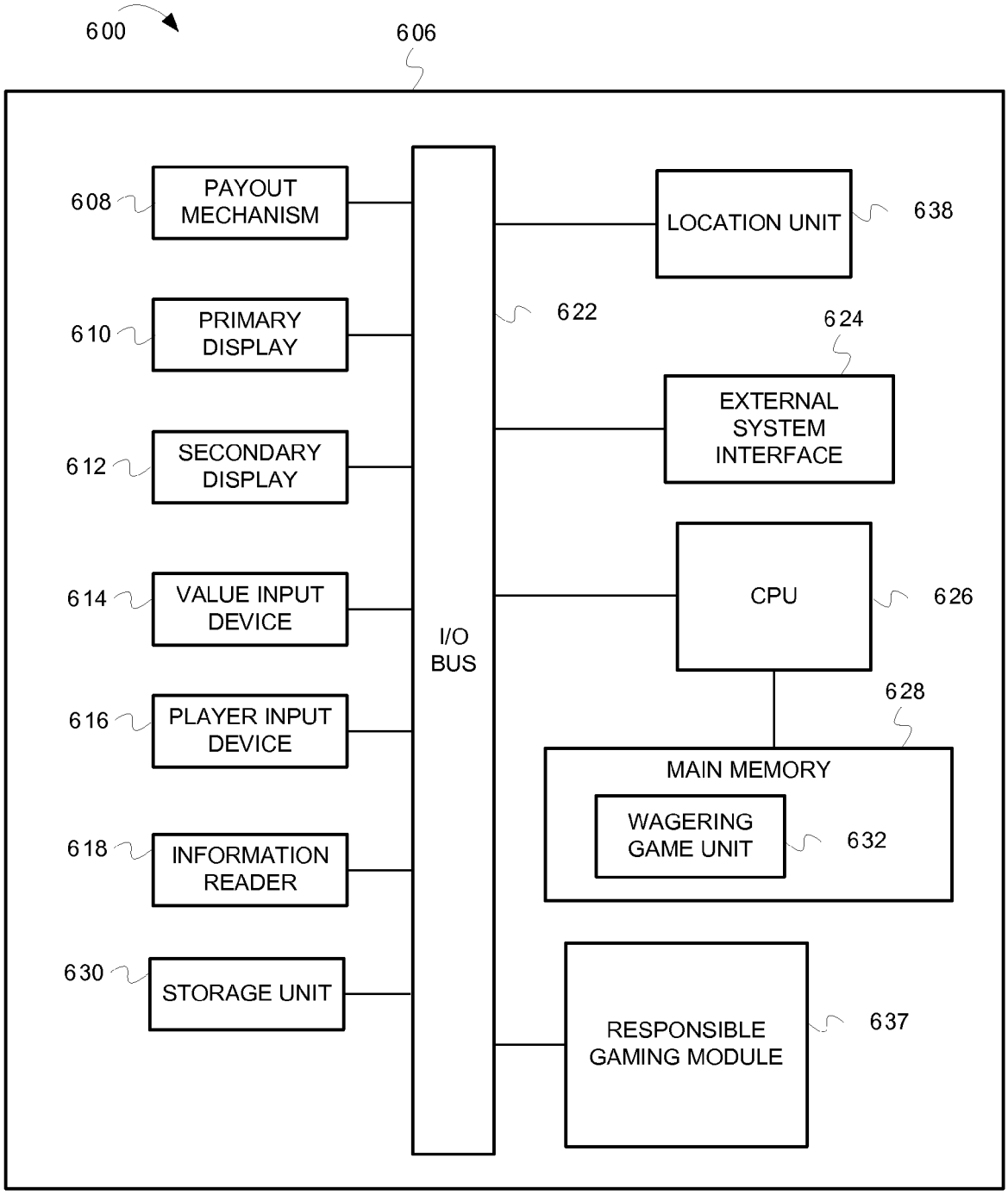
FIG. 6 is an illustration of a wagering game machine architecture 600, according to some embodiments.

FIG. 6 is a conceptual diagram that illustrates an example of a wagering game machine architecture 600, according to some embodiments. In FIG. 6, the wagering game machine architecture 600 includes a wagering game machine 606, which includes a central processing unit (CPU) 626 connected to main memory 628. The CPU 626 can include any suitable processor, such as an Intel® Pentium processor, Intel® Core 2 Duo processor, AMD Opteron™ processor, or UltraSPARC processor. The main memory 628 includes a wagering game unit 632. In some embodiments, the wagering game unit 632 can present wagering games, such as video poker, video black jack, video slots, video lottery, reel slots, etc., in whole or part.

The CPU 626 is also connected to an input/output ("I/O") bus 622, which can include any suitable bus technologies, such as an AGTL+ frontside bus and a PCI backside bus. The I/O bus 622 is connected to a payout mechanism 608, primary display 610, secondary display 612, value input device 614, player input device 616, information reader 618, and storage unit 630. The player input device 616 can include the value input device 614 to the extent the player input device 616 is used to place wagers. The I/O bus 622 is also connected to an external system interface 624, which is connected to external systems (e.g., wagering game networks). The external system interface 624 can include logic for exchanging information over wired and wireless networks (e.g., 802.11g transceiver, Bluetooth transceiver, Ethernet transceiver, etc.)

The I/O bus 622 is also connected to a location unit 638. The location unit 638 can create player information that indicates the wagering game machine's location/movements in a casino. In some embodiments, the location unit 638 includes a global positioning system (GPS) receiver that can determine the wagering game machine's location using GPS satellites. In other embodiments, the location unit 638 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 6, in some embodiments, the location unit 638 is not connected to the I/O bus 622.

In some embodiments, the wagering game machine 606 can include additional peripheral devices and/or more than one of each component shown in FIG. 6. For example, in some embodiments, the wagering game machine 606 can include multiple external system interfaces 624 and/or multiple CPUs 626. In some embodiments, any of the components can be integrated or subdivided.

In some embodiments, the wagering game machine 606 includes a responsible gaming module 637. The responsible gaming module 637 can process communications, commands, or other information, where the processing can configure, control, encourage and/or enforce responsible gambling for wagering games.

Furthermore, any component of the wagering game machine 606 can include hardware, firmware, and/or machine-readable media including instructions for performing the operations described herein.

Wagering Game Machine

Figure 7:
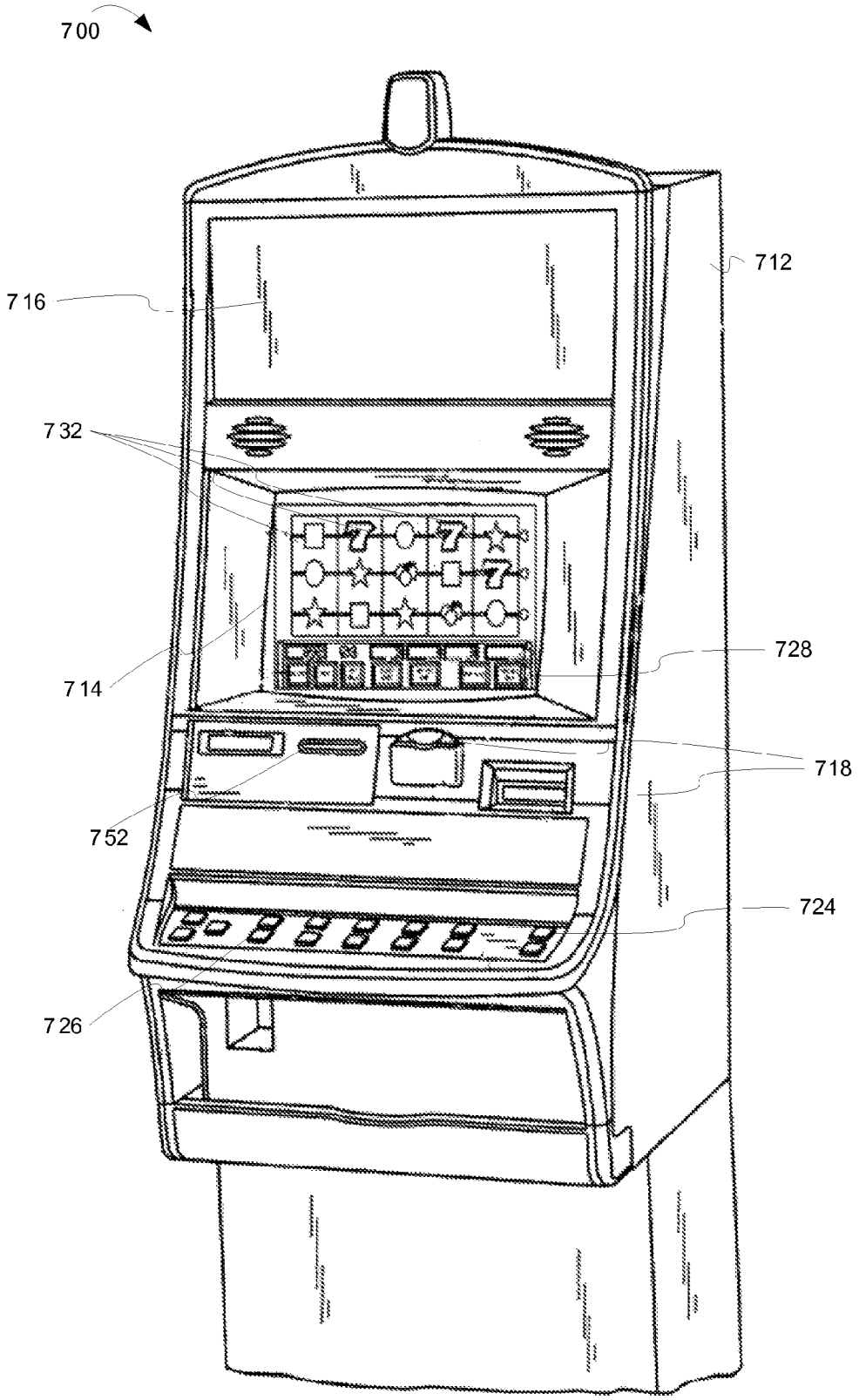
FIG. 7 is an illustration of a wagering game machine 700, according to some embodiments.

FIG. 7 is a conceptual diagram that illustrates an example of a wagering game machine 700, according to some embodiments. Referring to FIG. 7, the wagering game machine 700 can be used in gaming establishments, such as casinos. According to some embodiments, the wagering game machine 700 can be any type of wagering game machine and can have varying structures and methods of operation. For example, the wagering game machine 700 can be an electromechanical wagering game machine configured to play mechanical slots, or it can be an electronic wagering game machine configured to play video casino games, such as blackjack, slots, keno, poker, blackjack, roulette, etc.

The wagering game machine 700 comprises a housing 712 and includes input devices, including value input devices 718 and a player input device 724. For output, the wagering game machine 700 includes a primary display 714 for displaying information about a basic wagering game. The primary display 714 can also display information about a bonus wagering game and a progressive wagering game. The wagering game machine 700 also includes a secondary display 716 for displaying wagering game events, wagering game outcomes, and/or signage information. While some components of the wagering game machine 700 are described herein, numerous other elements can exist and can be used in any number or combination to create varying forms of the wagering game machine 700.

The value input devices 718 can take any suitable form and can be located on the front of the housing 712. The value input devices 718 can receive currency and/or credits inserted by a player. The value input devices 718 can include coin acceptors for receiving coin currency and bill acceptors for receiving paper currency. Furthermore, the value input devices 718 can include ticket readers or barcode scanners for reading information stored on vouchers, cards, or other tangible portable storage devices. The vouchers or cards can authorize access to central accounts, which can transfer money to the wagering game machine 700.

The player input device 724 comprises a plurality of push buttons on a button panel 726 for operating the wagering game machine 700. In addition, or alternatively, the player input device 724 can comprise a touch screen 728 mounted over the primary display 714 and/or secondary display 716.

The various components of the wagering game machine 700 can be connected directly to, or contained within, the housing 712. Alternatively, some of the wagering game machine's components can be located outside of the housing 712, while being communicatively coupled with the wagering game machine 700 using any suitable wired or wireless communication technology.

The operation of the basic wagering game can be displayed to the player on the primary display 714. The primary display 714 can also display a bonus game associated with the basic wagering game. The primary display 714 can include a cathode ray tube (CRT), a high resolution liquid crystal display (LCD), a plasma display, light emitting diodes (LEDs), or any other type of display suitable for use in the wagering game machine 700. Alternatively, the primary display 714 can include a number of mechanical reels to display the outcome. In FIG. 7, the wagering game machine 700 is an "upright" version in which the primary display 714 is oriented vertically relative to the player. Alternatively, the wagering game machine can be a "slant-top" version in which the primary display 714 is slanted at about a thirty-degree angle toward the player of the wagering game machine 700. In yet another embodiment, the wagering game machine 700 can exhibit any suitable form factor, such as a free standing model, bar top model, mobile handheld model, or workstation console model.

A player begins playing a basic wagering game by making a wager via the value input device 718. The player can initiate play by using the player input device's buttons or touch screen 728. The basic game can include arranging a plurality of symbols along a pay line 732, which indicates one or more outcomes of the basic game. Such outcomes can be randomly selected in response to player input. At least one of the outcomes, which can include any variation or combination of symbols, can trigger a bonus game.

In some embodiments, the wagering game machine 700 can also include an information reader 752, which can include a card reader, ticket reader, bar code scanner, RFID transceiver, or computer readable storage medium interface. In some embodiments, the information reader 752 can be used to award complimentary services, restore game assets, track player habits, etc.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

presenting wagering game content during a wagering game session via a wagering game machine;

detecting a time period specified by player input via the wagering game machine that presents the wagering game content;

determining an amount of money that a player has spent on gambling during the time period, wherein the amount of money is spent, at least in part, via the wagering game machine during the wagering game session;

presenting an indication of the amount of money spent during the time period while simultaneously presenting the wagering game content via the wagering game machine, during the wagering game session, so that the indication of the amount of money and the wagering game content are perceptible during the wagering game session; and presenting a comparison of the amount of money to spending by one or more additional players during the time period.

2. The computer-implemented method of claim 1, wherein presenting the indication of the amount of money comprises one or more of intrusively presenting indicators of wagering game loss amounts as one or more of graphic indicators in close proximity to a visual display of the wagering game content and sound indicators presented during the wagering game session.

3. The computer-implemented method of claim 1, wherein tracking the accounting transaction data comprises tracking a change in a player account balance during the wagering game session, and presenting visual representations of the change in the player account balance to represent the amount of money that the player has spent on gambling during the wagering game session.

4. The computer-implemented method of claim 1, further comprising:

determining a transaction report template pre-configured to present the indication of the amount of money on a display in close proximity to wagering game elements of the wagering game content; and presenting the indication of the amount of money, using the transaction report template, during the wagering game session.

5. The computer-implemented method of claim 1, further comprising:

exporting the indication of the amount of money; and presenting the indication of the amount of money on a financial report outside of the wagering game session.

6. One or more non-transitory machine-readable storage media having instructions stored thereon, which when executed by a set of one or more processors causes the set of one or more processors to perform operations comprising:

tracking accounting transaction data during a wagering game session for a player account, wherein the accounting transaction data relates to an amount of financial transactions that the player account has transacted on gambling during a time period;

determining one or more player preferences, for the player account, regarding the presentation of the accounting transaction data during the wagering game session;

presenting the accounting transaction data according to the one or more player preferences so that the accounting transaction data is perceptible during the wagering game session;

determining a transaction limit set in the one or more player preferences, wherein the transaction limit indicates a limit on a use of funds for the player account;

indicating the transaction limit during the wagering game session; and presenting one or more incentives for monetary marketing offers in exchange for terminating wagering activity when use of the funds approaches the transaction limit.

7. The one or more non-transitory machine-readable storage media of claim 6, said operations further comprising:

applying the transaction limit to one or more other accounts associated with the player account.

8. The one or more non-transitory machine-readable storage media of claim 6, wherein said operation of indicating the transaction limit comprises displaying a graphic of a limit value covering at least a portion of the wagering game elements presented during the wagering game session.

9. The one or more non-transitory machine-readable media of claim 6, said operations further comprising:

presenting one or more warnings messages indicating that the use of the funds is approaching the transaction limit.

10. The one or more non-transitory machine-readable storage media of claim 6, said operations further comprising:

calculating a reduced wager amount per spin of a wagering game played during the wagering game session;

calculating an additional time period, wherein when the reduced wager amount per spin is performed over the additional time period during the wagering game session, the use of the funds will comport with the transaction limit; and presenting the reduced wager amount and additional time period as a suggestion.

11. The one or more non-transitory machine-readable storage media of claim 6, said operations further comprising:

presenting one or more incentives for monetary marketing offers in exchange for terminating wagering activity when use of the funds approaches the transaction limit.

12. The one or more non-transitory machine-readable storage media of claim 6, said operations further comprising:

determining that the transaction limit has been exceeded; and restricting wagering game activities that can be performed during the wagering game session in response to determining that the transaction limit has been exceeded.

13. A system comprising:

a wagering game server configured to provide wagering game content during a wagering game session;

an account server configured to store a withdrawal limit set in one or more player preferences for a player account, wherein the withdrawal limit indicates an amount of funds that a player specifies can be withdrawn from an account balance within a specified time period; and a wagering game machine comprising a content controller configured to receive the wagering game content and present the wagering game content on a display, an account data controller configured to track withdrawals from the account balance during the wagering game session, determine that the withdrawals are approaching the amount of funds that the player specifies can be withdrawn from the player account within the specified time period, and present a warning on the display that covers at least a portion of wagering game elements from the wagering game content, wherein the warning indicates that the withdrawal limit is approaching the amount of funds that the player specifies can be withdrawn from the player account within the specified time period, and an incentives manager configured to present one or more incentives for monetary marketing offers in exchange for terminating wagering activity when the withdrawal limit approaches the amount of funds that the player specifies can be withdrawn.

14. The system of claim 13, said wagering game machine further comprising:

a report selection controller configured to select report templates that present financial transactions during the wagering game session.

15. The system of claim 13, wherein the account data controller is further configured to, generate financial graphs showing the accounting transaction data, and present the financial graphs on the display according to one or more pre-specified financial report templates.

16. An apparatus comprising:

a processor; and a responsible gaming module configured to, via the processor, determine wagering transaction data for a first player account associated with a first player, wherein the wagering transaction data relates to one or more wagering transactions that have been transacted during a time period in association with the first player account, wherein the time period includes one or more wagering game sessions, determine that the first player account is logged in to a wagering game machine for one of the one or more wagering game sessions, present the wagering transaction data and wagering game content at the same time, via the wagering game machine, during the one of the one or more wagering game sessions, and present, during the one of the one or more wagering game sessions, statistics of additional wagering transactions for additional player accounts associated with additional players, wherein the additional wagering transactions occur during the time period.

17. The apparatus of claim 16, wherein the responsible gaming module is further configured to generate a comparison between the wagering transaction data to the financial transaction statistics, and present the comparison in a comparison graphic during the wagering game session.

18. The apparatus of claim 16, wherein the responsible gaming module is further configured to determine that the first player account and the additional player accounts have one or more of common gaming practices and common financial backgrounds; and selecting the additional player accounts based on the one or more of the common gaming practices and the common financial backgrounds.

19. An apparatus comprising:

means for determining accounting transaction data for a player account over a time period specified by player input;

means for determining one or more player preferences, for the player account, regarding a trend for the accounting transaction data during a wagering game session;

means for presenting the accounting transaction data on a financial report on the display during the wagering game session as a graphical chart that indicates the trend over the time period;

means for determining that the trend experiences a change in the accounting transaction data within a portion of the time period; and means for indicating the change on the graphical chart, during the wagering game session, wherein the means for indicating the change on the graphical chart comprises means for simultaneously indicating on the graphical chart a first portion of the accounting transaction data for a first time within the time period prior to the change in the accounting transaction data and a second portion of the accounting transaction data for a second time within the time period after the change in the accounting transactions data.

20. The apparatus of claim 19 further comprising:

means for selecting a financial report template based on the trend; and means for presenting the graphical chart using the financial report template.

21. The apparatus of claim 19 further comprising:

means for analyzing the accounting transaction data during a fractional portion of the time period indicated by the player preferences; and means for presenting analysis of the accounting transaction data on the graphical chart as the trend per the fractional portion of the time period.

22. The apparatus of claim 21 further comprising:

means for determining a transaction limit set in the one or more player preferences; and means for indicating the transaction limit, on the financial report, during the wagering game session.

23. The apparatus of claim 19, further comprising:

means for determining that the transaction limit is exceeded; and means for presenting a warning message that intrudes on the wagering game session, wherein the warning message indicates that the transaction limit has been exceeded.

24. One or more non-transitory machine-readable storage media having instructions stored thereon, which when executed by a set of one or more processors causes the set of one or more processors to perform operations comprising:

tracking accounting transaction data during a wagering game session for a player account, wherein the accounting transaction data relates to an amount of financial transactions that the player account has transacted on gambling during a time period;

determining one or more player preferences, for the player account, regarding the presentation of the accounting transaction data during the wagering game session;

presenting the accounting transaction data according to the one or more player preferences so that the accounting transaction data is perceptible during the wagering game session;

determining a transaction limit set in the one or more player preferences, wherein the transaction limit indicates a limit on a use of funds for the player account;

indicating the transaction limit during the wagering game session;

calculating a reduced wager amount per spin of a wagering game played during the wagering game session;

calculating an additional time period, wherein when the reduced wager amount per spin is performed over the additional time period during the wagering game session, the use of the funds will comport with the transaction limit; and presenting the reduced wager amount and additional time period as a suggestion.

* * * * *